United States Patent [19]

Tsujimoto et al.

[11] 4,350,004

[45] Sep. 21, 1982

[54] MERCHANDISE DELIVERY CONVEYOR FOR AUTOMATIC BAGGING APPARATUS

[75] Inventors: Eiichi Tsujimoto, Kobe; Hiroshi Hirahara, Takarazuka; Makoto Matsumoto, Ashiya, all of Japan

[73] Assignee: Kawasaki Steel Corporation, Kobe, Japan

[21] Appl. No.: 181,223

[22] Filed: Aug. 25, 1980

[51] Int. Cl.[3] ..... B65B 43/14; B31B 1/76

[52] U.S. Cl. ..... 53/570; 53/390; 53/391; 198/721

[58] Field of Search ..... 53/77, 570, 571, 572, 53/390, 391; 198/721, 732

[56] References Cited

U.S. PATENT DOCUMENTS

| | | | |
|---|---|---|---|
| 2,958,990 | 11/1960 | Kerker | 53/571 X |
| 3,119,482 | 1/1964 | Ganz | 198/721 X |
| 3,564,814 | 2/1971 | Graveley | 53/572 |
| 3,699,741 | 10/1972 | Norman | 53/390 |
| 3,740,922 | 6/1973 | Liou | 53/390 X |
| 3,763,628 | 10/1973 | Bodolay | 53/572 |
| 3,774,370 | 11/1973 | Fried | 53/391 X |
| 4,274,245 | 6/1981 | Langen et al. | 53/390 X |
| 4,306,633 | 12/1981 | Langen et al. | 53/390 X |

*Primary Examiner*—Horace M. Culver

*Attorney, Agent, or Firm*—Wenderoth, Lind & Ponack

[57] ABSTRACT

A merchandise delivery conveyor apparatus for an automatic merchandise bagging apparatus including a bag receptacle pivotable from a horizontal position to a generally upright position for erecting the bag loaded with articles comprises an endless conveyor belt of a length sufficient to support a plurality of the loaded bags thereon, a multi-strand conveyor belt positioned between the bag receptacle and the endless conveyor belt for receiving the loaded bag from the bag receptacle when the latter is in the upright position and then transferring it to the endless conveyor, and a tilt preventing system for avoiding the possibility of fall-down of one or some loaded bags being transported towards a delivery zone. The tilt preventing system comprises a plurality of equally spaced tilt preventing arms, some being held in operative positions to hold the loaded bag between each adjacent two tilt preventing arms and some being held in inoperative positions.

16 Claims, 7 Drawing Figures

MERCHANDISE DELIVERY CONVEYOR FOR AUTOMATIC BAGGING APPARATUS

BACKGROUND OF THE INVENTION

The present invention generally relates to an automatic merchandise bagging apparatus and, more particularly, to a merchandise delivery conveyor for the automatic merchandise bagging apparatus.

The U.S. Pat. No. 2,958,990, patented Nov. 8, 1960, discloses an automatic merchandise bagging apparatus which comprises a stationary tray for receiving articles to be bagged, a bag receptacle for receiving a bag fed from a bag container accommodating a stack of bags, a bag mouth opening mechanism for opening the mouth of the bag resting on the bag receptacle, a hydraulically operated merchandise loader adapted to be driven by a hydraulic cylinder between stand-by and loading positions in a direction towards and away from the mouth-opened bag on the bag receptacle along the top surface of the stationary tray, and a delivery conveyor unit positioned on one side of the bag receptacle remote from the tray. The bag receptacle with the mouth-opened bag thereon is, after the articles have been loaded or filled into such bag incident to the movement of the merchandise loader from the stand-by position to the loading position, pivoted from a horizontal position towards an upright position to erect the loaded bag with the bag mouth opening upwards.

The delivery conveyor unit employed in the automatic merchandise bagging apparatus of the U.S. Pat. No. 2,958,990 is comprised of a substantially endless belt having one end so positioned adjacent the upright position of the bag receptacle and also adjacent the point of pivot of the bag receptacle that, soon after the bag receptacle has arrived at the upright position, the loaded bag then erected with the bag receptacle held in the upright position is delivered onto the conveyor belt. The delivery of the loaded bag from the bag receptacle onto the conveyor belt is carried out by causing a portion of the bottom of the loaded bag to rest on the trailing end of the conveyor belt with respect to the direction of transportation of the loaded bag to a delivery zone as the bag receptacle being pivoted approaches the upright position and then causing the conveyor belt to run. The conveyor belt is shown as having an effective length sufficient to support a plurality of, for example, three, loaded bags thereon.

The U.S. Pat. No. 3,774,370, patented Nov. 27, 1973, discloses a similar automatic merchandise bagging apparatus utilizing a conveyor belt for the merchandise delivery conveyor. While the bag receptacle employed in the appratus of the second-mentioned U.S. patent is, unlike that disclosed in the first mentioned U.S. patent, supported for pivotal movement between horizontal and upright positions, the point of pivot of the bag receptacle being positioned above the trailing end of the conveyor belt, the delivery of the loaded bag from the bag receptacle onto the conveyor belt is carried out in a manner similar to that effected in the appratus of the first-mentioned U.S. patent.

In both of the automatic merchandise bagging apparatuses, although the use of the conveyor belt is advantageous in that it can support a plurality of successively loaded bags temporarily before one or more of them are taken out from the delivery zone by the same customer or different customers, it has been found that one or some of the loaded bags successively delivered onto the conveyor belt one at a time from the bag receptacle and then being transported by means of the conveyor belt towards the delivery zone tend to fall down on the conveyor belt. This is particularly true where the loaded bags are top-heavy and/or where external shocks or impacts are applied to the loaded bags being transported on the conveyor belt in upright position. Once the bag has been fallen down, some of the articles loaded therein are scattered, thereby rendering not only the customer to be placed in embarrassed position but also the employment of the automatic bagging apparatus to be meaningless.

The copending U.S. patent application Ser. No. 91,816, filed Nov. 6, 1979 and now U.S. Pat. No. 4,306,399, the invention of which has been assigned to the same assignees of the present invention, discloses a unique merchandise delivery conveyor effective to substantially eliminate the above described disadvantages and inconveniences inherent in the prior art automatic merchandise bagging apparatuses. The merchandise delivery conveyor employed in the apparatus of the copending U.S. patent application comprises a generally L-shaped carriage movable between receiving and lifting positions along a guide rail and a bag lift movable between lifting and delivery positions in a direction generally perpendicular to the direction of movement of the L-shaped carriage. The merchandise delivery conveyor is so designed that, after the loaded bag has been transferred from the bag receptacle onto the L-shaped carriage, the L-shaped carriage with the loaded bag thereon is horizontally moved from the receiving position towards the lifting position at which the loaded bag is transferred onto the lifting carriage, the lifting carriage with the loaded bag thereon being then upwardly moved towards the delivery position where the loaded bag is exposed to the outside of the apparatus in readiness for the delivery thereof to the customer.

However, it has subsequently been found that the use of the carriages is less efficient than the use of the conveyor belt because, while the bagging rate of the apparatus of the copending U.S. patent application is high, the delivery unit including the carriages has no space for temporary storage of a plurality of loaded bags. Specifically, unless the customer removes the loaded bag from the lifting carriage as soon as the latter carrying such loaded bag arrives at the delivery position, the L-shaped carriage carrying another loaded bag is held standstill at the receiving position and, on the other hand, the bagging apparatus is held standstill until the L-shaped carrage moves from the receiving position towards the lifting position subsequent to the removal of the loaded bag from the lifting carriage. Where one customer has purchased the articles which require, for example, four bags for them to be filled therein, the customer will be bound to the delivery unit for a relatively long period of time until all of the loaded bags are successively transported one by one to the delivery zone.

SUMMARY OF THE INVENTION

Accordingly, the present invention has been developed in view to substantially eliminating the above described disadvantages and inconveniences inherent in the prior art automatic bagging appratuses and also in the automatic bagging apparatus of the copending U.S. patent application and has for its essential object to provide an improved merchandise delivery conveyor unit which effectively makes use of advantages inherent in these types of merchandise delivery conveyor units used in the prior art merchandise bagging apparatus, that is, which is effective not only to support or store a plurality of loaded bags without the bagging apparatus being halted before the delivery conveyor unit becomes completely occupied, but also to prevent the loading bag or bags on the delivery conveyor unit from being fallen down.

Another important object of the present invention is to provide an improved merchandise delivery conveyor unit of the type referred to above, which is effective to assist in increasing the customer handling capacity of the automatic merchandise bagging apparatus in a substantially trouble-free manner.

A further object of the present invention is to provide an improved merchandise delivery conveyor unit of the type referred to above, which is safe to operate and does not cause the customer to be worried about his goods or purchases being damaged not only during the transfer of the loaded bag from the merchandise bagging apparatus onto the delivery conveyor unit but also during the transportation thereof by means of the delivery conveyor unit.

A still further object of the present invention is to provide an improved merchandise delivery conveyor unit of the type referred to above, which can easily be manufactured without requiring any complicated manufacturing procedure.

According to a preferred embodiment of the present invention, the merchandise delivery conveyor unit effective to accomplish these and other objects of the present invention comprises a generally endless delivery conveyor extending from the upright position of the bag receptacle in the merchandise bagging apparatus towards a delivery zone at which the customer or customers can take his or their loaded bags away from the delivery conveyor, and means including a plurality of equally spaced arms for preventing loaded bags being successively transported towards the delivery zone by means of the delivery conveyor while standing on the upper run of the delivery conveyor in upright position from being fallen down. The preventing means also includes a generally endless chain drivingly turned around drive and driven sprocket wheels which are positioned respectively adjacent and above the opposite ends of the delivery conveyor.

The equally spaced arms are connected at one end to the endless chain for pivotal movement between an operative position, in which each of the arms protrudes laterally outwardly of the endless chain and transversely of the direction of transportation of the loaded bags by means of the delivery conveyor, and an inoperative position in which each of the arms protrudes downwardly of the endless chain and laterally of the delivery conveyor. The endless chain is driven in the same direction as and in synchronism with the delivery conveyor such that the arms carried by the endless chain move at the same speed as that of the delivery conveyor, some of the arms on the lower run of the endless chain being successively pivoted from the inoperative position to the operative positions while the remaining arms on the upper run of the endless chain are successively pivoted from the operative position to the inoperative positions.

Each adjacent two of the arms being moved while assuming the operative positions during the movement of the endless chain are effective to hold a corresponding loaded bag therebetween thereby preventing the corresponding loaded bag from being fallen down.

The delivery conveyor unit embodying the present invention may also comprise an auxiliary or access conveyor positioned between the upright position of the bag receptacle and the adjacent end of the delivery conveyor for transferring the loaded bags from the bag receptacle in the upright position onto the delivery conveyor one at a time without being interferred by a corresponding arm ready to pivot from the inoperative position towards the operative position during the movement of the endless chain. This access conveyor may be inclined downwardly towards the delivery conveyor at an angle of up to 15°, preferably within the range of 8° to 10°.

BRIEF DESCRIPTION OF THE DRAWINGS

These and other objects and features of the present invention will become apparent from the following description of the present invention taken in conjunction with a preferred embodiment thereof with reference to the accompanying drawings, in which.

DETAILED DESCRIPTION OF THE INVENTION

Figure 1:
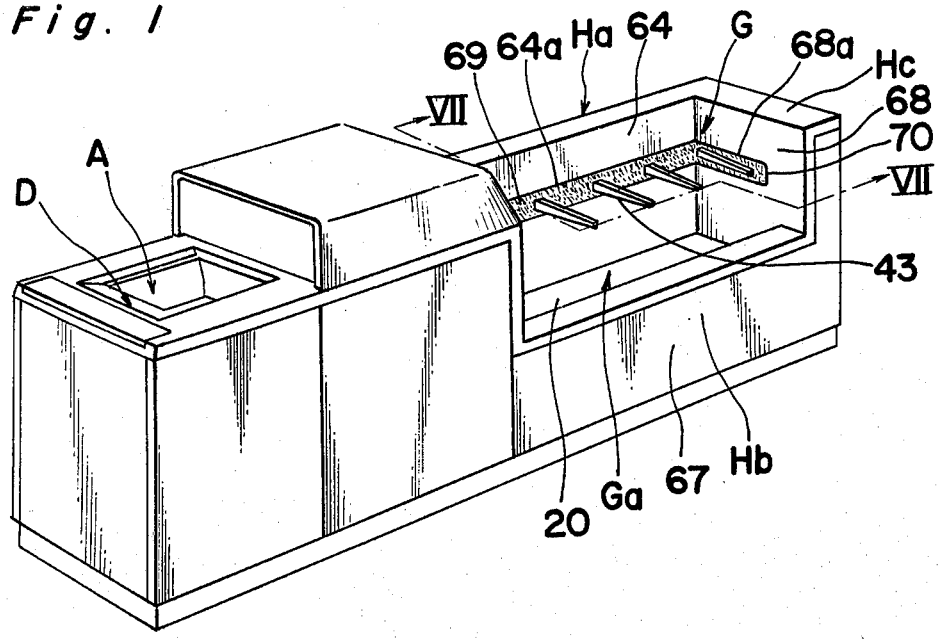
FIG. 1 is a perspective view of an automatic merchandise bagging apparatus including a delivery conveyor unit embodying the present invention, as viewed in one direction.

Before the description of the present invention proceeds, it is to be noted that like parts are designated by like reference numerals throughout the accompanying drawings.

Figure 2:
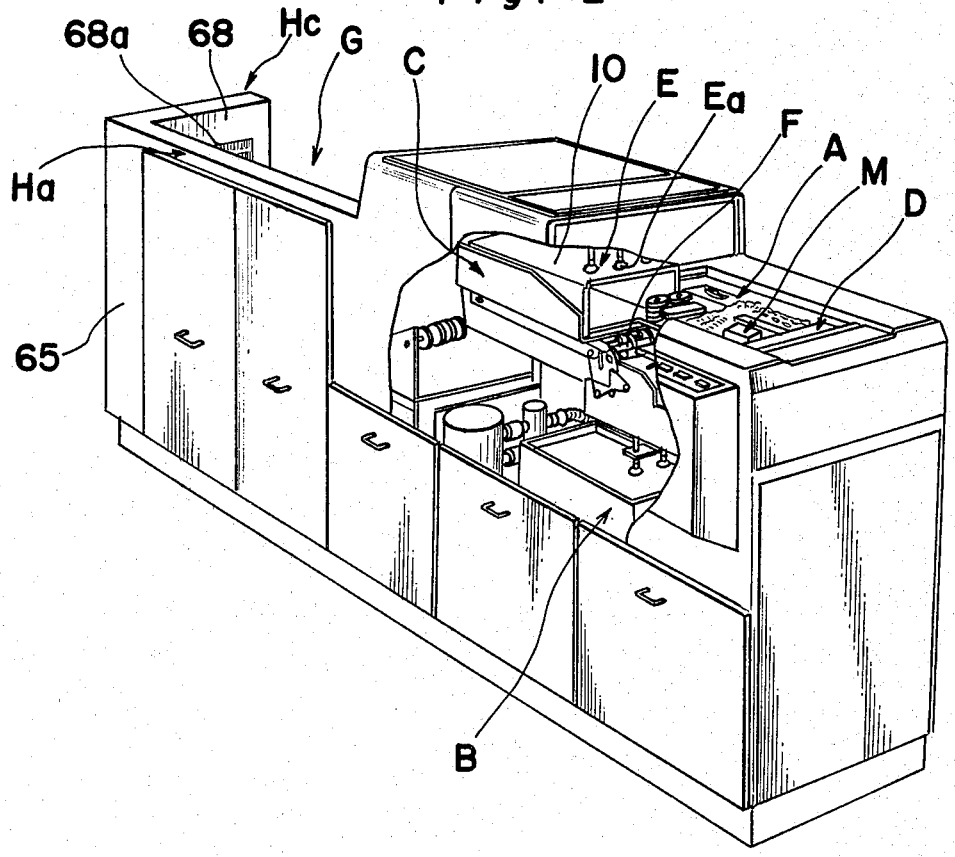
FIG. 2 is a view similar to FIG. 1, as viewed in a different direction, showing some of interior mechanisms of the automatic merchandise bagging apparatus.
Figure 3:
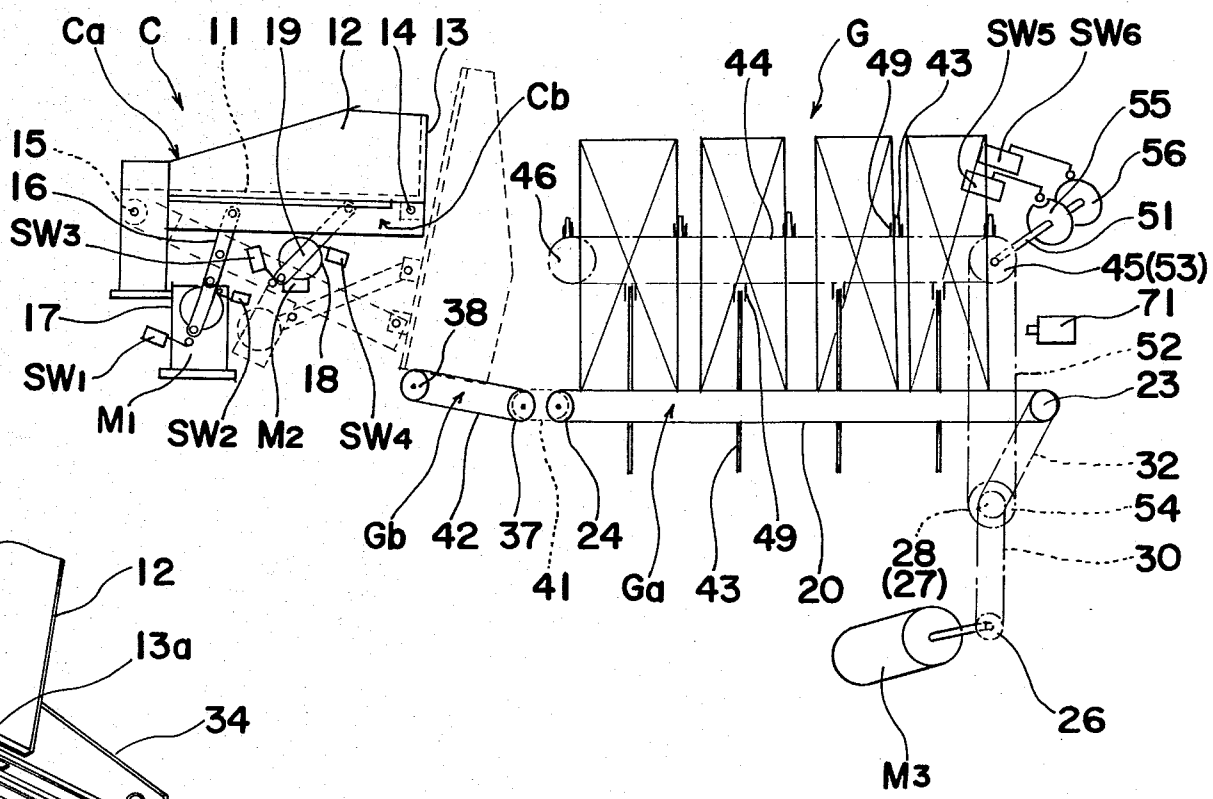
FIG. 3 is a schematic diagram showing the merchandise delivery unit according to the present invention.

Referring first to FIGS. 1 to 3, an automatic merchandise bagging apparatus to which the present invention can be applicable and which may be of a construction disclosed in the previously mentioned copending U.S. patent application comprises a movable tray assembly A of generally U-shaped cross section for the support of articles M to be bagged, said movable tray assembly A being supported for movement between retracted and inserted positions; a bag container B for the storage of a stack of paper bags of equal size in collapsed condition; a bag receptacle unit C operatively positioned adjacent the inserted position of the tray assembly A and capable of supporting the bag 10, which has been fed from the bag container B, thereon in a manner with its mouth facing towards the tray assembly A; a bag feeder mechanism for successively feeding the bags from the bag container B towards the bag receptacle unit C one at a time; a loader assembly D supported for movement between pushed and withdrawn positions in a direction parallel to the direction of movement of the tray assembly A, said loader assembly D substantially forming the rear wall of the tray assembly A with respect to the direction of movement of the tray assembly A towards the inserted position and operable to withhold and push the to-be-bagged articles M towards the bag 10 lying on the bag receptacle unit C during the movement of the tray assembly A, said tray assembly when moved to the inserted position having its front portion inserted into the bag on the bag receptacle unit C; a bag mouth opening mechanism E including a plurality of vertically shiftable suction heads Ea for opening the mouth of the bag 10 on the bag receptacle unit C to bring the bag 10 in a mouth-opened condition, said bag mouth opening mechanism E being operable subsequent to the arrival of the bag 10 at the bag receptacle unit C from the bag container B; a bag mouth retainer mechanism F for retaining the mouth of the bag on the bag receptacle unit C in the mouth-opened condition until the loader assembly D once moved to the pushed position is returned towards the withdrawn position subsequent to the return of the tray assembly A back to the retracted position leaving the to-be-bagged articles M inside the mouth-opened bag 10; and a gating assembly (not shown) supported for movement between closed and opened positions in a direction perpendicular to the direction of movement of the tray assembly A, said gating assembly when in the closed position substantially forming the front wall of the tray assembly in opposition to the loader assembly D, said gating assembly when in the opened position permitting the passage of both of the tray assembly A and the loader assembly D past the gating assembly.

Figure 4:
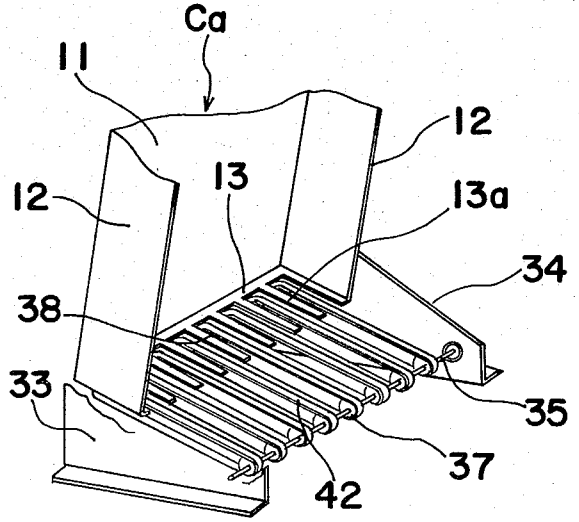
FIG. 4 is a perspective view, on an enlarged scale, of an access conveyor employed in the merchandise delivery conveyor unit and shown in association with a bag receptacle.

The bag receptacle unit C includes a bag receptacle Ca, constituted by a generally rectangular flat bottom wall 11, a pair of opposed side walls 12 and a generally comb-shaped end wall 13 as best shown in FIG. 4, and a generally rectangular tiltable platform Cb, said bag receptacle Ca being pivotally connected at one end of the bottom wall 11 adjacent the comb-shaped end wall 13 thereof to said tiltable platform Cb by means of a pair of axially aligned hinge pins 14. Accordingly, the bag receptacle Ca is pivotable about the hinge pins 14 between a receiving position, in which the bottom wall 11 of the bag receptacle Ca is held in parallel to the direction of movement of the tray assembly A and as shown by the solid line in FIG. 3, and a transfer or generally upright position in which the bag receptacle Ca is generally erected at a predetermined angle relative to the platform Cb and as shown by the phantom line in FIG. 3.

The tiltable platform Cb is pivotally connected at one end opposed to the hinge pins 14 to a machine framework (not shown) by means of a pair of axially aligned hinge pins 15, so that the platform Cb can be tiltable together with the bag receptacle Ca between a horizontal position, as shown by the solid line in FIG. 3, and a tilted position as shown by the phantom line in FIG. 3 about the longitudinal axis of any one of the hinge pins 15. For effecting the pivotal movement of the tiltable platform Cb between the horizontal and tilted positions in the manner described above, there is employed a crank arm 16 having one end pivotally connected to the platform Cb and the other end pivotally connected to a crank wheel 17, said crank wheel 17 being rigidly mounted on a drive shaft of an electrically operated motor M1 which is stationarily positioned on the machine framework. A drive mechanism including the motor M1, the crank arm 16 and the crank wheel 17 is preferably so designed that half the complete rotation of the motor M1 results in the pivotal movement of the platform Cb through a predetermined acute angle about the longitudinal axis of any one of the hinge pins 15 from the horizontal position to the tilted position, and vice versa. Therefore, it will readily be seen that one complete rotation of the motor M1 results in the reciprocal pivotal movement of the platform Cb from the horizontal position and then back to the horizontal position past the tilted position.

The bag receptacle Ca is held in the receiving position when the platform Cb is in the horizontal position, and remains the same though tilted together with the platform Cb when the latter is pivoted to the tilted position. However, this bag receptacle Ca is brought to the generally upright position, as shown by the phantom line in FIG. 3, when and after the platform Cb has been pivoted to the tilted position.

The bag 10 loaded with the articles to be bagged, which has been held in a horizontally laying condition when the platform Cb is in the horizontal position, can be brought in a substantially upright position with the mouth thereof facing upwards after the platform Cb has been pivoted to the tilted position. For this purpose, another drive mechanism is employed and comprises an electrically operated motor M2 rigidly carried by and positioned underneath the platform Cb, said motor M2 having the drive shaft on which a crank wheel 18 is rigidly mounted for rotation together with said drive shaft of the motor M2. The crank wheel 18 is operatively coupled to the bag receptacle Ca by means of a crank arm 19 having one end pivotally connected to the bag receptacle Ca and the other end pivotally connected to said crank wheel 18.

The drive mechanism including the motor M2, the crank wheel 18 and the crank arm 19 is preferably so designed that half the complete rotation of the motor M2 results in the pivotal movement of the bag receptacle Ca through a predetermined angle about the longitudinal axis of any one of the hinge pins 14 from the receiving position to the transfer or upright position, and vice versa. Accordingly, it will readily be seen that one complete rotation of the motor M2 results in the reciprocal pivotal movement of the bag receptacle Ca from the receiving position and then back to the receiving position past the transfer or upright position.

It is to be noted that the first mentioned drive mechanism including the motor M1 may be positioned on either one or both sides of the platform Cb. Where the first mentioned drive mechanism is employed on each side of the platform Cb, the motor M1 may be of a type having a pair of opposed drive shafts extending in the opposite directions away from each other. It is also to be noted that the second mentioned drive mechanism including the motor M2 may be positioned substantially intermediately of the width of the platform Cb or the bag receptacle Ca, or it may be constructed in a manner similar to the first mentioned drive mechanism.

Microswitches SW1 and SW2 are utilized to detect the position of the platform Cb and are adapted to be turned off when the platform Cb is in the tilted and horizontal positions, respectively. Microswitches SW3 and SW4 are utilized to detect the position of the bag receptacle Ca and are adapted to be turned off when the bag receptacle Ca is in the upright and receiving positions, respectively.

The system wherein, in erecting the loaded bag 10, the platform Cb is tilted together with the bag receptacle Ca and then the bag receptacle Ca is pivoted to the upright position, such as described above with particular reference to FIG. 3 is advantageous in that the height of the front portion of the automatic bagging apparatus in terms of the direction of movement of the customer past the cashier's station at a supermarket can be minimized to the level of the waist of the customer.

Moreover, with the above described system, there is no substantial possibility that some of the articles loaded in the bag and positioned adjacent the mouth of the bag may roll over the mouth of the bag to the outside of such bag, which would likely to occur under the influence of vibrations at the time of a sudden start of movement of the bag receptacle Ca from the receiving position towards the upright position if the platform Cb were fixed relative to the machine framework. As can readily be recoginizeable by those skilled in the art, since the bag receptacle Ca is pivotable from the receiving position towards the upright position only after the platform Cb has been pivoted to the tilted position together with the bag receptacle Ca, some of the articles loaded in the bag and positioned adjacent the mouth thereof are forced to move towards the bottom of the bag by the effect of the gravitational force during the tilting of the platform Cb together with the bag receptacle Ca and, therefore, the above described possibility can advantageously be minimized.

Since the construction of the automatic bagging apparatus so far described is disclosed in the previously mentioned copending U.S. patent application, reference may be had to such copending U.S. patent application for further details thereof. However, for the purpose of the present invention and by the reason which will become clear from the subsequent description, the sum of the predetermined acute angle through which the tiltable platform Cb is pivoted from the horizontal position to the tilted position and the predetermined angle through which the bag receptacle is pivoted from the receiving position to the upright position should be within the range of 90° to 50°, preferably within the range of 98° to 100°. By way of example, while the predetermined acute angle for the tiltable platform is preferred to be 30°, the predetermined angle for the bag receptacle Ca is within the range of 60° to 75°, preferably within the range of 68° to 70° relative to the platform Cb.

Hereinafter, the details of the merchandise delivery conveyor unit, generally identified by G in FIGS. 1 and 2, will be described. As shown in FIGS. 1 to 3, the delivery conveyor unit G is so positioned on one side of the bag receptacle unit C opposite to the tray assembly A that the loaded bag 10 having been erected in the manner described hereinbefore can be received thereby and transported therethrough towards the delivery zone.

Figure 5:
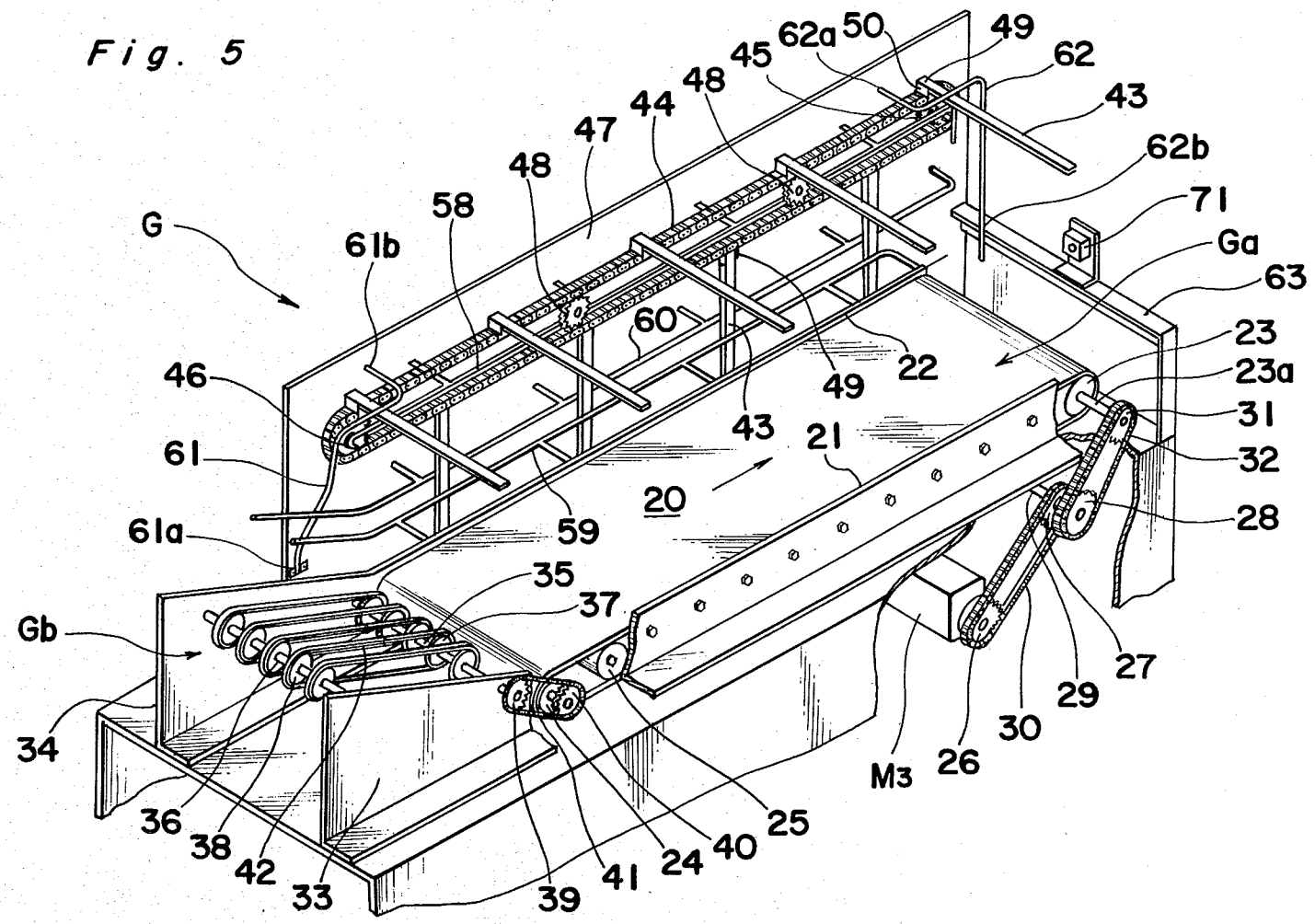
FIG. 5 is a perspective view, on an enlarged scale, of the merchandise delivery conveyor unit according to the present invention.

As best shown in FIG. 5, the delivery conveyor unit G so far illustrated comprises a delivery conveyor Ga comprised of an endless or substantially endless conveyor belt 20 and an access conveyor Gb in the form of a multi-strand conveyor belt positioned between the delivery conveyor Ga and the bag receptacle C.

The delivery conveyor Ga comprises a pair of elongated side frames 21 and 22 rigidly mounted in the machine framework in spaced and parallel relation to each other, head or drive and take-up rollers 23 and 24, and a plurality of idler rollers 25 positioned between the head and take-up rollers 23 and 24, all of said rollers 23, 24 and 25 extending in parallel relation to each other and transversely of any one of the side frames 21 and 22 and rotatably connected at their opposite ends to the associated side frames 21 and 22. The endless conveyor belt 20 is turned around the head and take-up rollers 23 and 24 and is adapted to be driven in one direction with its upper run moving in a direction away from the access conveyor Gb as shown by the arrow in FIG. 5 during rotation of the head roller 23. The head roller 23 is driven by an electric motor M3, which may be rigidly carried by the machine framework below the delivery conveyor Ga and which is drivingly coupled to a drive shaft **23*a* by means of any suitable transmission system, it being to be understood that the drive shaft 23*a* extends from one end of the head roller 23 rotatably through the side frame 21 and terminating at one side of the side frame 21 opposite to the head roller 23**.

So far illustrated, the transmission system for transmitting a drive of the motor M3 to the head roller 23 comprises a drive sprocket wheel 26 rigidly mounted on a power output shaft of the motor M3, first and second intermediate sprocket wheels 27 and 28 rigidly mounted on an intermediate drive shaft 29, an endless chain 30 turned around and extending between the drive sprocket wheel 26 and the first intermediate sprocket wheel 27, a driven sprocket wheel 31 rigidly mounted on the drive shaft **23*a* fast with the head roller 23, and an endless chain 32 turned around and extending between the second intermediate sprocket wheel 28 and the driven sprocket wheel 31**. However, although the transmission system of a construction described above is a chain drive system, it should be noted that it may be a belt drive system.

The access conveyor Gb comprises a pair of spaced, generally triangular side plates 33 and 34 rigidly mounted on the machine framework at a position intermediately between the bag receptacle unit C and the delivery conveyor Ga in spaced relation to each other. These side plates 33 and 34 may be either constituted by respective members separately of the side frames 21 and 22 or formed integrally with the side frames 21 and 22 such as shown. Extending between the triangular side plates 33 and 34 are drive and driven shafts 35 and 36, each having its opposed ends journalled to the respective triangular side plates 33 and 34 and having a plurality of, for example, eight as shown in FIG. 4, pulleys rigidly mounted thereon, the pulleys on the drive shaft 35 and the pulley on the driven shaft 36 being generally identified by 37 and 38, respectively. It is to be noted that, as best shown in FIG. 5, one end of the drive shaft 35 adjacent the side plate 33 extends rotatably through the side plate 33 and has a driven gear 39 rigidly mounted thereon and positioned on one side of the side plate 33 opposite to the pulleys 37 on the drive shaft 35. The driven gear 39 is drivigly coupled to a drive gear 40, which is rigidly mounted on a shaft extending from one end of the takeup roller 24 rotatably through the side frame 21 in a manner similar to the drive shaft 23 fast with the head roller 23, by means of an endless chain 41 turned around and extending between the drive gear 40 and the driven gear 39.

Turned around and extending between the pulleys 37 on the drive shaft 35 and the pulleys 38 on the driven shaft 36 are endless or substantially endless V-belts 42 adapted to be driven in one direction with the respective upper runs of the V-belts 42 moving in a direction close towards the delivery conveyor Ga and away from the bag receptacle unit C.

In the construction so far described, it will readily be seen that, during the operation of the motor M3, the endless conveyor belt 20 is driven in the direction of the arrow with the upper run thereof moving away from the access conveyor or multi-strand conveyor belt Gb, the movement of the conveyor belt 20 being in turn transmitted to the multi-strand conveyor belt Gb through the endless chain 41 to drive the multi-strand conveyor belt Gb in the same direction as the conveyor belt 20 with the individual upper runs of the endless V-belts 42 moving in a direction close towards the delivery conveyor Ga and away from the bag receptacle unit C.

Depending on the angle of inclination which the bag receptacle Ca assumes relative to the platform Cb when such bag receptacle Ca is held in the upright position after the platform C has been pivoted to the tilted position, at least the upper runs of the associated V-belts 42 of the multi-strand conveyor belt Gb may or may not be inclined downwardly towards the delivery conveyor Ga. Where the upper runs of the V-belts 42 are downwardly inclined towards the delivery conveyor Ga such as shown, the angle of inclination of the upper runs of the V-belts 42 should be up to 15°, preferably within the range of 8° to 10°, relative to the horizontally lying delivery conveyor Ga. In such case, the bag receptacle unit C and the multi-strand conveyor belt Gb should be so positioned relative to each other that, when the bag receptacle Ca is held in the upright position subsequent to the movement of the platform Cb to the tilted position, fingers 13*a* in the comb-shaped end wall 13 of the bag receptacle Ca can be interdigitated with the corresponding pulleys 38 on the driven shaft 36 and also respective portions of the V-belts 42 adjacent the pulleys 38 and extend in parallel relation to and slightly underneath the upper runs of the V-belts 42 without touching the driven shaft 36 in a manner as best shown in FIG. 4.

The employment of the inclined multi-strand conveyor belt Gb described above is advantageous in that a smooth and substantially trouble-free transfer of the loaded bag from the bag receptacle Ca onto the delivery conveyor Ga can readily be achieved, because there is no possibility that the loaded bag transferred onto the multi-strand conveyor belt Gb in the manner described hereinbefore would tilt rearwardly with respect to the direction of transportation thereof towards the delivery zone and subsequently fall down.

The merchandise delivery conveyor unit G further comprises a tilt preventing system effective to avoid any possible fall-down of one or more loaded bags being transported by means of the delivery conveyor Ga while they stand in upright position on the conveyor belt 20 with their mouths facing upwards, which will now be described with particular reference to FIGS. 3 and 5 to 7.

The tilt preventing system comprises a plurality of, for example, nine so far illustrated, tilt preventing arms which are generally identified by 43, each of said tilt preventing arms 43 being mounted on an endless carrier chain 44 for pivotal movement between operative and inoperative positions in a manner as will be described later.

The endless carrier chain 44 is, as best shown in FIG. 5, turned around and extends between drive and driven sprocket wheels 45 and 46 positioned laterally above the delivery conveyor Ga and at a level spaced a predetermined height upwardly from the plane of movement of the upper run of the conveyor belt 20, said predetermined height being preferably equal to or larger than half the depth of, but smaller than the depth of, the hollow of the paper bag with which the automatic bagging apparatus can work. These sprocket wheels 45 and 46 are rotatably supported by any suitable support structure, for example, a generally rectangular support plate 47 which may be reinforced by the use of a plurality of rib members and which is rigidly mounted on the machine framework at a position laterally of the delivery conveyor Ga. A drive mechanism including the carrier chain 44 and the sprocket wheels 45 and 46 for driving the tilt-preventing arms 43 may include a plurality of, for example, two as shown, idler sprocket wheels 48 rotatably carried by the support plate 47 for avoiding any possible slackening of the upper run of the carrier chain 44 and also for avoiding any possible arbitrary lateral displacement of the upper run of the carrier chain 44 during the movement of the latter.

Figure 6:
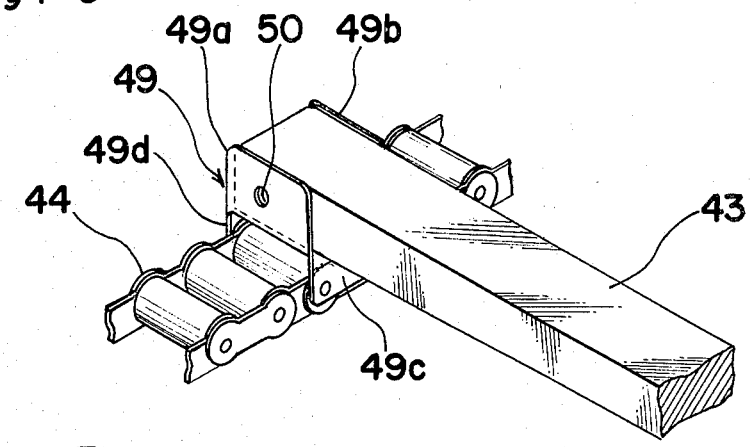
FIG. 6 is a perspective view, on an enlarged scale, showing the manner in which each of arms is pivotally mounted on an endless chain.

The tilt preventing arms 43 carried by the carrier chain 43 in a manner as will be detailed later are equally spaced from each other, the space between each adjacent two of said tilt preventing arms 43 being sufficient to hold a corresponding loaded bag therebetween. Each of the tilt preventing arms 43 has one end pivotally connected to the carrier chain 44 through a respective bracket member 49. Each of the bracket members 49 is prepared from a metallic, generally cross-shaped plate and is, as best shown in FIG. 6, shaped to have a pair of spaced bearing lugs 49*a* and 49*b* for receiving said one end of the respective tilt preventing arm 43 and also a pair of spaced bearing lugs 49*c* and 49*d* connected to, and positioned on respective sides of, the carrier chain 44, said pairs of the bearing lugs 49*a*, 49*b* and 49*c*, 49*d* protruding in the opposite directions with respect to each other and being offset relative to each other. The end of the respective tilt preventing arm 43 so received in a space between the bearing lugs 49*a* and 49*b* of the respective pair is pivotally connected thereto by means of a pivot pin 40, such that said tilt preventing arm 43 can pivot between the operative and inoperative positions about the pivot pin 40.

Figure 7:
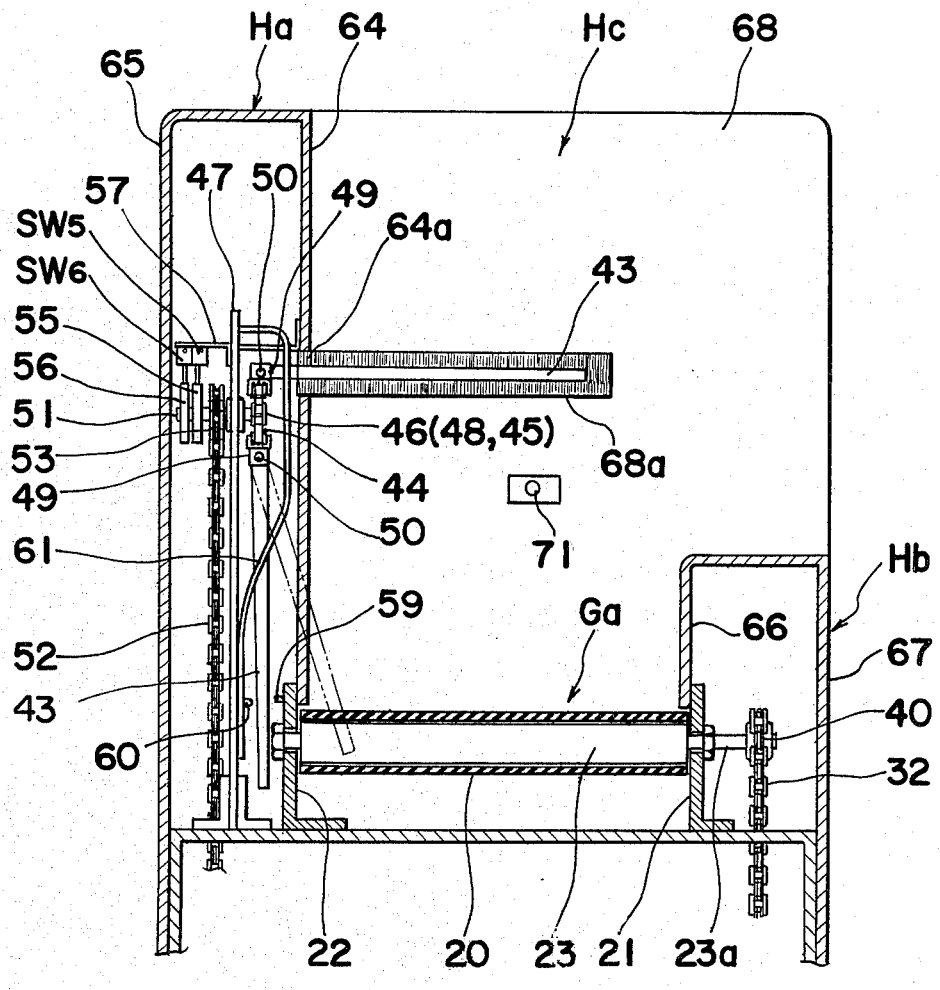
FIG. 7 is a cross sectional view, on an enlarged scale, taken along the line VII—VII shown in FIG. 1.

As best shown in FIG. 7, a shaft 51 having one end on which the drive sprocket wheel 45 is rigidly mounted extends rotatably through the support plate 47 in any known manner with its other end positioned on one side of the support plate 47 opposite to the drive sprocket wheel 45. This shaft 51 is drivingly coupled to the intermediate drive shaft 29 by means of a transmission system including an endless chain 52 turned around and extending between sprocket wheels 53 and 54 which are respectively rigidly mounted on the shafts 51 and 29, the sprocket wheel 54 being schematically shown in FIG. 3. Rigidly mounted on the shaft 51 and positioned adjacent the sprocket wheel 53 is first and second cam discs 55 and 56 operatively associated with microswitches SW5 and SW6 which are carried by a common support 57 secured to the support plate 47, the function of each of said microswitches SW5 and SW6 in connection with the respective cam disc 55 or 56 being described later.

Rigidly secured to the support plate 47 and extending generally in parallel to the upper run of the carrier chain 44 and on one side of the carrier chain 44 opposite to the support plate 47 is an elongated arm rest 58 for relatively slidingly supporting from below some of the tilt preventing arms 43 which are then successively pivoted to the operative position and, therefore, carried by the upper run of the carrier chain 44 as best shown in FIG. 5. It is to be noted that some of the tilt preventing arms 43 successively assume the operative positions during the movement of the carrier chain 44 driven by the drive sprocket wheel 45 and taken up by the driven sprocket wheel 46 while the remaining tilt preventing arm 43 successively assume the inoperative positions, the tilt preventing arms 43 in the inoperative positions being carried by the lower run of the carrier chain 44. Some of the tilt preventing arms 43 when in the respective operative positions protrude laterally of the upper run of the carrier chain 44 towards a space immediately above the upper run of the conveyor belt 20 while slidingly resting on the elongated arm rest 58. On the other hand, some of the tilt preventing arms 43 when in the respective inoperative positions protrude downwardly from the lower run of the carrier chain 44 towards a space between the side frame 22 and the support plate 47.

In order to avoid an undesirable swinging motion of some of the tilt preventing arms 43 on the lower run of the carrier chain 44 during the movement thereof through the space between the side frame 22 and the support plate 47 in a direction towards the access conveyor Gb, a pair of spaced guide rails 59 and 60 are employed, the guide rail 59 being supported by the side frame 22 in any suitable manner in spaced relation thereto and the guide rail 60 being supported by the support frame 47 in any suitable manner in spaced relation thereto. These guide rails 59 and 60 defines therebetween a passage through which some of the tilt preventing arms 43 successively on the lower run of the carrier chain 44 and, therefore, in the inoperative positions loosely move.

The tilt preventing system further comprises a deflecting bar 61 for forcibly pivoting the tilt preventing arms 43 one at a time from the inoperative positions towards the operative positions as they turn successively around the driven sprocket wheel 46, and a folding bar 62 for forcibly pivoting the tilt preventing arms 43 one at a time from the operative positions towards the inoperative positions as they turn successively around the drive sprocket wheel 46. The deflecting bar 61 has its opposite ends rigidly secured at 61*a* and 61*b* to the support plate 47, a substantially intermediate portion of said deflecting bar 61 being positioned on one side of the driven sprocket wheel 46 opposite to the support plate 47 as will subsequently be detailed and as can readily be understood from FIGS. 5 and 7.

With particular reference to FIGS. 5 and 7, the deflecting bar 61 extends upwardly from the lower portion of the support plate 47, where the end 61*a* thereof is rigidly connected, so as to diverge from the support plate 47, is then curved gently at a position above and intermediately of the space between the guide rails 59 and 60 so as to extend generally in parallel to the support plate 47 and is, after having been deflected at a position adjacent the driven sprocket wheel 46 so as to extend above the upper run of the carrier chain 44 generally in parallel to the elongated arm rest 58, again deflected laterally towards the support plate 47 with the end 61*b* rigidly connected to the support plate 47. This deflecting bar 61 is so shaped and so positioned as to cause each of the tilt preventing arms 43 being successively turned around the driven sprocket wheel 46 to pivot from the inoperative position to the operative position in the following manner so long as the carrier chain 44 is being moved in a direction required to move some of the tilt preventing arms 43 in the operative positions in a direction away from the access conveyor Gb.

(a) The respective tilt preventing arm 43 tending to move around the driven sprocket wheel 46 while protruding in a direction radially outwardly of the driven sprocket wheel 46 is first brought into contact with that portion of the deflecting bar 61 which diverges from the support plate 47 and slides along that diverging portion of the deflecting bar 61 while pivoting from the inoperative position towards the operative position about the corresponding pivot pin 50, thereby permitting the respective tilt preventing arm 43 not to project radially outwardly of the driven sprocket wheel 43 in a direction generally parallel to the upper run of the conveyor belt 20.

(b) As the respective tilt preventing arm 43 moving in sliding contact with the deflecting bar 61 subsequently approaches that portion of the deflecting bar 61 which is curved at the position adjacent the driven sprocket wheel 46 so as to extend generally in parallel to the elongated arm rest 58, the tilt preventing arm 43 is pivoted to the operative position in contact with that curved portion of the deflecting bar 61 and/or under the influence of a gravitational force.

It is to be noted that that portion of the deflecting bar 61 which extends generally in parallel relation to the elongated arm rest 58 assures that all of the tilt preventing arms 43 being successively pivoted in the above described manner are held in the operative positions one at a time even though, because of the presence of friction, some of the tilt preventing arms 43 would not pivot smoothly.

On the other hand, the folding bar 62 functions in a manner substantially reverse to the function of the deflecting bar 60, that is, to fold the tilt preventing arms 43 from the operative positions into the inoperative positions. So far illustrated, this folding bar 62 is shown as having one end rigidly secured at 62*a* to the support plate 47 and the other end 62*b* welded to, or otherwise rigidly connected to an end frame member 63 fixed to the machine framework, a substantially intermediate portion thereof being curved at two points such that it extends, in terms of the direction from the end 62*a* to the end 52*b*, above the upper run of the carrier chain 44 at right angles to the support plate 47, then generally in parallel to the support plate 27 and finally downwardly towards the end frame member 63 as best shown in FIG. 5.

Referring to FIGS. 1, 2 and 7, there is shown how the various component parts of the delivery conveyor unit G are housed. The housing for the delivery conveyor unit G is shown as a part of the housing for the automatic bagging apparatus as a whole and includes a pair of opposed double-walled side wall structures Ha and Hb, positioned on respective sides of the delivery conveyor Ga, and a double-walled end wall structure Hc positioned adjacent one end of the delivery conveyor Ga opposite to the bag receptacle unit C. The height of the double-walled side wall structure Hb above the floor on which the automatic bagging apparatus is installed is so smaller than that of the double-walled side wall structure Ha as to provide an access opening through which the customer or customers can take their loaded bags out of the delivery conveyor Ga.

As best shown in FIG. 7, the double-walled side wall structure Ha includes a pair of spaced inner and outer panels 64 and 65, the space therebetween accommodating the support plate 47 and its associated component parts including the carrier chain 44. Similarly, the double-walled side wall structure Hb includes a pair of spaced inner and outer panels 66 and 67, the space therebetween accommodating the sprocket wheel 40 and its associated component parts, and the double-walled end wall structure Hc includes a pair of spaced inner and outer panels (only the inner panel being shown by 68), the space therebetween accommodating the end frame member 63 and its associated parts.

The inner panels 64 and 68 of the respective wall structures Ha and Hc have horizontally extending slots 64*a* and 68*a* defined therein. The slot 64*a* extends a distance corresponding to the effective length of the delivery conveyor Ga in a direction lengthwisely of the delivery conveyor Ga and permits some of the tilt preventing arms 43 to protrude outwardly of the double-walled side wall structure Ha and to terminate above the upper run of the conveyor belt 20. The slot 68*a* extends a distance sufficient to pass each of the tilt preventing arms 43 in the operative positions therethrough into the space between the inner and outer panels of the end wall structure Hc and has one end contiguous to and in communication with the adjacent end of the slot 64*a* in the inner panel 64 of the side wall structure Ha.

As best shown in FIGS. 1 and 7, in order to prevent any foreign matters from entering through the slots 64*a* and 68*a* into the respective spaces inside the wall structures Ha and Hc, these slots 64*a* and 68*a* are shielded by respective flexible brush curtains 69 and 70 in any suitable manner known to those skilled in the art.

While the merchandise delivery conveyor unit G according to the present invention is constructed in the manner as hereinbefore described, care must be taken so as to avoid any possible interference which would take place between each one of the tilt preventing arms 43 and the bag receptacle Ca when the latter is in the upright position with the platform Cb held in the tilted position. More specifically, unless any meatures are taken, any one of the tilt preventing arms 43 to be pivoted from the inoperative position towards the operative position as it turns around the driven sprocket wheel 46 would interfere with the bag receptacle in the upright position while the platform Cb is in the tilted position, thereby disabling the return of the bag receptacle Ca from the upright position back to the receiving position. This possibility can advantageously be avoided by intermittently rotating the motor M3 and, hence, by intermittently moving the multi-strand conveyor belt Gb and the delivery conveyor belt 20 in synchronism with each other, every a distance about half the space between each adjacent two of the tilt preventing arms 43 and sufficient to allow the bag receptacle Ca in the upright position with the platform Cb held in the tilted position to return to the receiving position prior to the tilt preventing arm 43 being completely pivoted to the operative position. For this purpose the microswitches SW5 and SW6 in operative association with the first and second cam discs 55 and 56 are employed for controlling the operation of the motor M3.

Rigidly mounted on the end frame member 63 is a photoelectric detector 71 (FIGS. 3 and 5) for detecting the presence of the loaded bag being transported towards the end of movement of the upper run of the conveyor belt 20 and for generating an electric signal necessary to halt the automatic bagging apparatus when such loaded bag has been detected thereby.

Hereinafter, the operation of the merchandise delivery conveyor unit G according to the present invention will be described.

Assuming that the articles to be bagged have already been loaded or filled into the bag 10 while the bag had been in the bag receptacle Ca, the motor M1 is rotated in response to the return of the loader assembly D to the withdrawn position. As the motor M1 is rotated through half the complete rotation thereof, the platform Cb with the bag receptacle Ca thereon is moved about the pivot pins 15 from the horizontal position towards the tilted position. The motor M2 is then rotated through half the complete rotation thereof in response to the arrival of the platform Cb at the tilted position, causing the bag receptacle Ca with the loaded bag thereon to pivot from the receiving position towards the upright position while the platform Cb is in the tilted position, as shown by the phantom lines in FIG. 3.

As the bag receptacle Ca, while the platform Cb is in the tilted position, approaches the upright position as a result of the rotation of the motor M2, the fingers 13*a* of the comb-shaped end plate 13 of the bag receptacle Ca are interdigitated with the driven pulleys 38 on the shaft 36 of the multi-strand conveyor belt Gb in the manner as best shown in FIG. 4. Accordingly, the loaded bag then erected with its mouth facing upwards is loaded on the multi-strand conveyor belt Gb with its bottom separated from the fingers 13*a* of the end plate 13 on one hand and held in contact with the V-belts 42 on the other hand.

Simultaneously with and in response to the arrival of the bag receptacle Ca at the upright position as shown by the phantom line in FIG. 3, the motor M2 is deenergized and the motor M3 is rotated until the microswitch SW5 is turned off by the first cam disc 55 so rotated together with the motor M3 in the manner as hereinbefore described. It is to be noted that, at the time of start of rotation of the motor M3 during each cycle of operation of the delivery conveyor unit G, one of the tilt preventing arms 43 in the operative positions, which is the nearest to the bag receptacle Ca in the upright position, is located immediately above the driven sprocket wheel 46 as best shown in FIGS. 3 and 5 and is spaced from the bottom wall 11 of the bag receptacle Ca in the upright position a distance sufficient to avoid any possible fall-down of the loaded bag being transferred from the bag receptacle Ca onto the multi-strand conveyor belt Gb.

The drive of the motor M3 is transmitted not only to both of the conveyor belt 20 and the carrier chain 44, but also to the multi-strand conveyor belt Gb through the conveyor belt 20, in the manner as hereinbefore described. Accordingly, all of these belt 20, carrier chain 44 and multi-strand conveyor belt Gb are driven in the same direction in synchronism with each other. The first cam disc 55 is so shaped as to turn the microswitch SW5 off after the loaded bag transferred onto the multi-strand conveyor belt Gb is moved a distance about half the pitch between each adjacent two of the tilt preventing arms 43, said pitch corresponding to the thickness of the loaded bag as measured in the direction of transportation thereof towards the delivery zone. More specifically, the distance through which the loaded bag is transported prior to the switching-off of the microswitch SW5 is such that the next succeeding tilt preventing arm 43 which is ready to pivot from the inoperative position to the operative position and which should occupy a position rearwardly of the loaded bag with respect to the direction of transportation thereof towards the delivery zone through the delivery conveyor Ga does neither constitute an obstruction to, nor disturb the return movement of the bag receptacle Ca from the upright position towards the receiving position while the platform Cb is still in the tilted position. Accordingly, at the time the microswitch SW5 is turned off, the loaded bag being transported may partly rest on the multi-strand conveyor belt Gb and partly on the conveyor belt 20, straddling the boundary between the multi-strand conveyor belt Gb and the delivery conveyor Ga, but completely separating from the bag receptacle Ca in the upright position.

Subsequently, the motor M2 is again rotated in response to the switching-off of the microswitch SW5 to return the bag receptacle Ca in the upright position back towards the receiving position while the platform Cb is still in the tilted position. However, the platform Cb is subsequently returned from the tilted position towards the horizontal position by the motor M1 which is again rotated in response to the arrival of the bag receptacle Ca to the receiving position.

Thereafter, the motor M3 is again rotated in response to the return of the platform Cb to the horizontal position to transport the loaded bag a distance corresponding to about half the pitch between each adjacent two of the tilt preventing arms 43 and until the microswitch SW6 is turned off by the second cam disc 56. An electric signal generated by the miroswitch SW6 upon the opening thereof is indicative of the completion of transportation of the loaded bag through a distance generally equal to the pitch between the adjacent two of the tilt preventing arms 43, which pitch in turn corresponds to the maximum possible thickness of the bag attained when the bag is filled with the articles. This electric signal is applied to a central control unit of the automatic bagging apparatus to enable the latter to undergo the next succeeding cycle of operation.

In the event that either the delivery conveyor Ga is completely occupied by a plurality of the loaded bags or one of the loaded bags nearest to the end wall structure Hc remains unremoved from the delivery conveyor Ga, the photoelectric detector 71 generates an output signal to the central control unit to disable the subsequent operation of the automatic bagging apparatus.

Although the present invention has fully been described in connection with the preferred embodiment thereof with reference to the accompanying drawings, it is to be noted that various changes and modifications are apparent to those skilled in the art. By way of example, although the deflecting bar 61 has been described as stationarily carried by the support plate 47, the employment of a combination of an electric reversible motor and a generally L-shaped deflecting bar having one end rigidly connected to the shaft of the reversible motor is possible. In such case, the other end portion of the L-shaped deflecting bar should extend vertically so that, when the reversible motor is rotated in one direction in response to the opening of the miroswitch SW5, the L-shaped deflecting bar is engaged to the respective tilt preventing arm 43, which protrude in a direction generally radially outwardly of the driven sprocket wheel 46 and which is still in the inoperative position, to pivot the tilt preventing arm 43 from the inoperative position towards the operative position. In addition, the folding bar 62 may be a single straight rod secured to the end frame member 63.

Moreover, where the merchandise delivery conveyor unit G according to the present invention is desired to be used in conjunction with the bag receptacle unit of a construction disclosed in either of the previously mentioned U.S. patent, the access conveyor Gb may be comprises of an endless belt similar to the conveyor belt 20.

Such changes and modifications are, unless they depart from the true scope of the present invention defined by the appended claims, to be construed as included therein.

We claim:

1. For use with an automatic merchandise bagging apparatus for automatically loading articles to be bagged into a bag, said bagging apparatus comprising a bag erecting means for the support of bags supplied thereto one at a time, said erecting means being supported for pivotal movement between horizontal and erected positions and pivotable from the horizontal position towards the erected position to erect the bag with its mouth generally facing upwards after the articles have been loaded into the bag during the positioning of the erecting means at the horizontal position, a merchandise delivery conveyor apparatus which comprises, in combination:

a merchandise delivery conveyor unit including a main endless conveyor of a length sufficient to support a plurality of the loaded bags thereon in line with each other and having one end positioned adjacent the erected position of the bag erecting means;

a first drive means for intermittently driving the main endless conveyor in one direction required to transport the loaded bags successively in a direction away from the bag erecting means and towards the other end of the main endless conveyor;

a tilt preventing means including a plurality of tilt preventing arms, drive and driven wheel members rotatably supported respectively at positions laterally of and above the opposite ends of the main endless conveyor, and an endless carrier member drivingly turned around and extending between the drive and driven wheel members, said tilt preventing arms being connected at one end to the endless carrier member in equally spaced relation to each other for pivotal movement between operative and inoperative positions, the space between each adjacent two tilt preventing arms being so selected as to hold the corresponding loaded bag therebetween;

a second drive means for driving the drive wheel member to move the endless carrier member in the same direction as and in synchronism with the main endless conveyor;

a deflecting means for causing the tilt preventing arms to pivot from the inoperative positions towards the operative positions one at a time as said tilt preventing arms are successively turned around one of said drive and driven wheel members during the movement of the endless carrier member; and a folding means for causing the tilt preventing arms in the operative positions to pivot towards the inoperative positions one at a time as said tilt preventing arms are successively turned around the other of said drive and driven wheel members during the movement of the endless carrier member, whereby the loaded bag transferred from the bag erecting means onto the main endless conveyor and subsequently transported towards the other end of the main endless conveyor is positioned between every adjacent two tilt preventing arms in the operative positions one on each side of such loaded bag.

2. A conveyor apparatus as claimed in claim 1, wherein said main endless conveyor comprises drive and driven rollers, an endless belt turned around and extending between the drive and driven rollers, and a plurality of intermediate idler rollers operatively positioned between the drive and driven rollers and arranged in parallel to each other and also to any one of the drive and driven rollers, and wherein said first drive means comprises an electric motor and an endless chain drivingly extending between the electric motor and the drive roller.

3. A conveyor apparatus as claimed in claim 2, wherein said second drive means comprises an endless chain drivingly extending between the electric motor and the drive wheel member.

4. A conveyor apparatus as claimed in claim 1, wherein said carrier member comprises an endless chain and wherein each of said drive and driven wheel members is constituted by a sprocket wheel.

5. A conveyor apparatus as claimed in claim 2, wherein said carrier member comprises an endless chain and wherein each of said drive and driven wheel members is constituted by a sprocket wheel.

6. A conveyor apparatus as claimed in claim 5, further comprising an auxiliary endless conveyor positioned between the main endless conveyor and the erected position of the bag erecting means, and a third drive means for driving the auxiliary endless conveyor in the same direction as and in synchronism with the main endless conveyor.

7. A conveyor apparatus as claimed in claim 6, wherein said bag erecting means includes a bag receptacle constituted by a generally rectangular bottom wall, a pair of opposed side walls and a generally comb-shaped end wall, said bag receptacle when the erecting means is in the erected position assuming a generally upright position wherein the bottom wall and the comb-shaped end wall extend generally vertically and generally horizontally, respectively, and wherein said auxiliary endless conveyor is constituted by a multi-strand conveyor belt including a plurality of equally spaced and parallel endless belts, the space between each adjacent two endless belts of the multi-strand conveyor belt being so selected as to pass one of fingers of the comb-shaped end wall therethrough.

8. A conveyor apparatus as claimed in claim 7, wherein said third drive means comprises an endless chain for transmitting the movement of the main endless conveyor to the auxiliary endless conveyor.

9. A conveyor apparatus as claimed in claim 7, wherein said multi-strand conveyor belt is downwardly inclined from the erected position of the erecting means towards the main endless conveyor.

10. A conveyor apparatus as claimed in claim 7, 8 or 9 wherein said deflecting means comprises a deflecting bar positioned adjacent said one of the drive and driven wheel members and so shaped as to cause each one of the tilt preventing arms to pivot from the inoperative position towards the operative position in sliding contact therewith as it turns around said one of the drive and driven wheel members.

11. A conveyor apparatus as claimed in claim 10, wherein said folding means comprises a folding bar positioned adjacent said other of the drive and driven wheel members and so shaped as to cause each one of the tilt preventing arms in the operative positions to pivot towards the inoperative position in sliding contact therewith as it turns around said other of the drive and driven wheel members.

12. A conveyor apparatus as claimed in claim 1, 2, 3, 4, 6, 7 or 9, further comprising an elongated arm rest extending laterally of and on one side of the endless carrier member adjacent the main endless conveyor for supporting some of the tilt preventing arms in the operative position from below so as to permit them to protrude above the main endless conveyor in a direction transversely of the main endless conveyor, and a pair of spaced guide rails positioned below the endless carrier member for guiding some of the tilt preventing arms in the inoperative positions to pass therethrough while they extend downwards.

13. A conveyor apparatus as claimed in claim 5, further comprising an elongated arm rest extending laterally of and on one side of the endless carrier member adjacent the main endless conveyor for supporting some of the tilt preventing arms in the operative position from below so as to permit them to protrude above the main endless conveyor in a direction transversely of the main endless conveyor, and a pair of spaced guide rails positioned below the endless carrier member for guiding some of the tilt preventing arms in the inoperative positions to pass therethrough while they extends downwards.

14. A conveyor apparatus as claimed in claim 10, further comprising an elongated arm rest extending laterally of and on one side of the endless carrier member adjacent the main endless conveyor for supporting some of the tilt preventing arms in the operative positions from below so as to permit them to protrude above and in a direction transversely of the main endless conveyor, and a pair of spaced guide rails positioned below the endless carrier member for guiding some of the tilt preventing arms in the inoperative positions to pass therethrough while they extends downwards.

15. A conveyor apparatus as claimed in claim 3, wherein said carrier member comprises and endless chain and wherein each of said drive and driven wheel members is constituted by a sprocket wheel.

16. A conveyor apparatus as claimed in claim 11, further comprising an elongated arm rest extending laterally of and on one side of the endless carrier member adjacent the main endless conveyor for supporting some of the tilt preventing arms in the operative position from below so as to permit them to protrude above the main endless conveyor in a direction transversely of the main endless conveyor, and a pair of spaced guide rails positioned below the endless carrier member for guiding some of the tilt preventing arms in the inoperative positions to pass therethrough while they extend downwards.

* * * * *